US011525342B2

(12) United States Patent
Langlais

(10) Patent No.: US 11,525,342 B2
(45) Date of Patent: Dec. 13, 2022

(54) ALTERNATE PATH MANIFOLD LIFE EXTENSION FOR EXTENDED REACH APPLICATIONS

(71) Applicant: Schlumberger Technology Corporation, Sugar Land, TX (US)

(72) Inventor: Michael Dean Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 100 days.

(21) Appl. No.: 16/975,260

(22) PCT Filed: Feb. 26, 2019

(86) PCT No.: PCT/US2019/019473

§ 371 (c)(1),
(2) Date: Aug. 24, 2020

(87) PCT Pub. No.: WO2019/165392

PCT Pub. Date: Aug. 29, 2019

(65) Prior Publication Data

US 2021/0363862 A1 Nov. 25, 2021

Related U.S. Application Data

(60) Provisional application No. 62/635,188, filed on Feb. 26, 2018.

(51) Int. Cl.

| | |
|---|---|
| ***E21B 43/10*** | (2006.01) |
| ***E21B 43/04*** | (2006.01) |
| ***E21B 43/08*** | (2006.01) |

(52) U.S. Cl.

CPC ..... *E21B 43/10* (2013.01); *E21B 43/04* (2013.01); *E21B 43/08* (2013.01)

(58) Field of Classification Search

CPC ..... E21B 43/04; E21B 43/08; E21B 43/10; E21B 17/10

See application file for complete search history.

(56) References Cited

U.S. PATENT DOCUMENTS

| | | | | |
|---|---|---|---|---|
| 6,749,023 | B2 | 6/2004 | Nguyen et al. | |
| 7,562,709 | B2 | 7/2009 | Saebi et al. | |
| 10,907,451 | B2 | 2/2021 | Coffin et al. | |
| 2002/0174984 | A1 | 11/2002 | Jones | |
| 2008/0314588 | A1* | 12/2008 | Langlais | E21B 43/04 166/278 |

(Continued)

FOREIGN PATENT DOCUMENTS

| | | | |
|---|---|---|---|
| WO | 2005045185 | A1 | 5/2005 |
| WO | 2011137074 | A1 | 11/2011 |

(Continued)

OTHER PUBLICATIONS

Official Action issued in Azerbaijan Patent Application No. a 2020 0077 dated Aug. 11, 2021, 6 pages with English translation.

(Continued)

*Primary Examiner* — George S Gray
(74) *Attorney, Agent, or Firm* — Matthew Goode

(57) ABSTRACT

A technique facilitates formation of a gravel pack along relatively lengthy wellbores. According to an embodiment, a completion system comprises a screen assembly and an alternate path system disposed along the screen assembly. The alternate path system may include a transport tube and a packing tube placed in fluid communication at a manifold. The manifold is disposed along the screen assembly. In some embodiments, the completion system may comprise multiple screen assemblies with multiple corresponding manifolds. The packing tube is protected against erosion by a liner and a surrounding housing which are positioned to conduct fluid flow from the manifold as fluid flow moves from the transport tube, through the manifold, and into the packing tube during a gravel packing operation.

8 Claims, 2 Drawing Sheets

(56) References Cited

U.S. PATENT DOCUMENTS

| | | | | |
|---|---|---|---|---|
| 2013/0000899 | A1 | 1/2013 | Broussard et al. | |
| 2013/0112399 | A1* | 5/2013 | Royer | E21B 41/0078 166/222 |
| 2013/0233541 | A1 | 9/2013 | Nutley et al. | |
| 2013/0255943 | A1 | 10/2013 | Yeh et al. | |
| 2014/0014314 | A1* | 1/2014 | Cunningham | E21B 43/08 166/51 |
| 2014/0238657 | A1* | 8/2014 | Sladic | E21B 41/0078 166/51 |
| 2019/0145231 | A1* | 5/2019 | Sessa | E21B 43/088 166/51 |

FOREIGN PATENT DOCUMENTS

| | | | |
|---|---|---|---|
| WO | 2017155546 | A1 | 9/2017 |
| WO | 2020206211 | A1 | 10/2020 |

OTHER PUBLICATIONS

International Preliminary Report on Patentability issued in PCT application PCT/US2019/019473, dated Sep. 3, 2020 (9 pages).
Bonner et al., 2014, Design and Validation of an Improved Shunt Tube System, SPE-169440-MS (21 pages).
International Search Report and Written Opinion issued in PCT application PCT/US2019/019473, dated Jun. 5, 2019 (14 pages).
International Search Report and Written Opinion issued in PCT Application PCT/US2020/026521 dated Jul. 27, 2021 (14 pages).
International Preliminary Reporton Patentability issued in PCT Application PCT/US2020/026521 dated Oct. 14, 2021, 9 pages.

* cited by examiner

ALTERNATE PATH MANIFOLD LIFE EXTENSION FOR EXTENDED REACH APPLICATIONS

CROSS-REFERENCE TO RELATED APPLICATION

The present document is based on and claims priority to U.S. Provisional Patent Application Ser. No. 62/635,188, filed Feb. 26, 2018, which is incorporated herein by reference in its entirety.

BACKGROUND

Gravel packs are used in wells for removing particulates from inflowing hydrocarbon fluids. Generally, a completion having a sand screen assembly or a plurality of sand screen assemblies is deployed downhole in a wellbore and a gravel pack is formed around the completion. To facilitate the gravel pack, the completion may include an alternate path system to help prevent premature slurry dehydration in open hole gravel packs. An alternate path system utilizes transport tubes and packing tubes which provide an alternate path for gravel slurry delivery. The transport tubes deliver gravel slurry to the packing tubes via crossover ports. However, directing the gravel slurry into the packing tubes can cause erosion of the packing tubes which can sometimes lead to holes, fractures, and/or other packing tube damage.

Attempts have been made to resist erosion by cladding an exterior of the packing tube at a location downstream of the crossover port. However, the material of the packing tube remains subject to erosive flow internally of the cladding. Once the packing tube material is thinned out sufficiently, the packing tube can lose its pressure bearing capacity and cracks can develop in the relatively brittle cladding material. As a result, the packing tube can burst under the pressures reached during packing of relatively lengthy wellbores. Additionally, some cladding processes involve inserting an end of the packing tube into the structure containing the crossover port and then welding the packing tube to the structure. Subsequently, cladding material is added, but this can result in a time-consuming and expensive manufacturing process.

SUMMARY

In general, a system and methodology are provided for facilitating formation of a gravel pack along relatively lengthy wellbores. According to an embodiment, a completion system comprises a screen assembly and an alternate path system disposed along the screen assembly. The alternate path system may include a transport tube and a packing tube placed in fluid communication at a manifold. The manifold is disposed along the screen assembly. In some embodiments, the completion system may comprise multiple screen assemblies with multiple corresponding manifolds. The packing tube is protected against erosion by a liner and a surrounding housing which are positioned to conduct fluid flow from the manifold as fluid flow moves from the transport tube, through the manifold, and into the packing tube during a gravel packing operation.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
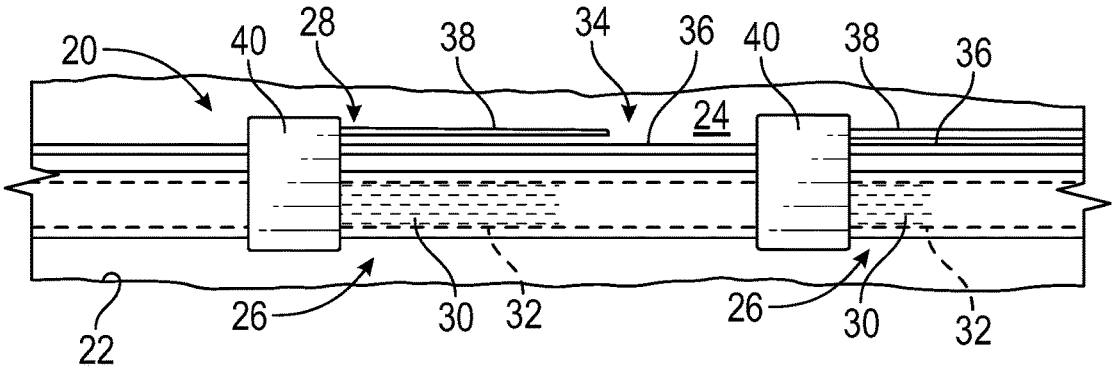
FIG. 1 is a schematic illustration of a portion of a completion deployed in a wellbore and having an alternate path system, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology to facilitate formation of gravel packs in wellbores and thus the subsequent production of well fluids. A well completion is provided with an alternate path system for carrying gravel slurry along an alternate path so as to facilitate improved gravel packing during a gravel packing operation. The system and methodology are very useful for facilitating formation of a gravel pack along relatively lengthy wellbores, such as extended reach open hole wells having wellbore lengths of, for example, 4000-8000 feet. However, the system and methodology may be used with wells having lengths greater or less than this range.

In some of these relatively lengthy wellbore applications, pressures in the packing tubes at the heel of the completion can rise above, for example, 4000 psi and even up to 8000 psi or more. It should be noted gravel packing operations for these types of longer wellbores can utilize substantially increased proppant volumes. The increased flow of proppant via gravel slurry as well as the higher pressures can potentially lead to increased erosion of the alternate path system and especially increased erosion of the packing tubes.

According to an embodiment, a completion system comprises a screen assembly and an alternate path system disposed along the screen assembly. The alternate path system may include a transport tube and a packing tube placed in fluid communication at a manifold. The manifold is disposed along the screen assembly. The packing tube is protected against erosion by a liner and a surrounding housing which are positioned to conduct fluid flow from the manifold as fluid flow moves from the transport tube, through the manifold, and into the packing tube during a gravel packing operation. During a gravel packing operation, for example, the fluid flow is in the form of a gravel slurry carrying proppant through the transport tube and into the packing tube via a crossover port in the manifold. In some embodiments, the completion system may comprise multiple screen assemblies with multiple corresponding manifolds disposed along a wellbore.

In various embodiments, the manifold (or manifolds) is responsible for the functionality enabling an alternate path system so as to achieve long distance open hole gravel packs. The manifold delivers slurry (which is a combination of suspension fluid and proppant, e.g. gravel) to the wellbore annulus by diverting flow through a crossover port in the manifold from transport tubes into packing tubes. The packing tubes then deliver the slurry to the annulus. Once the wellbore annulus is packed with proppant, e.g. gravel, at a given well zone, the proppant effectively backs up through the packing tube all the way to the manifold. The packed proppant/gravel in the packing tubes presents a restriction which inhibits further flow of suspension fluid through those packing tubes.

The restriction effectively forces the slurry to flow farther along the wellbore through the transport tubes and out through packing tubes in subsequent well zones to ensure proppant is carried to the toe of the well during lengthy gravel packs. Sometimes a substantial portion of the open hole wellbore may be packed via flow of slurry through a relatively small number of the packing tubes. This can further increase the chance of packing tube erosion—at least without utilizing the system and methodology described herein.

Referring generally to FIG. 1, an example of a downhole completion 20 is illustrated as deployed in a wellbore 22, e.g. an open hole wellbore. The downhole completion 20 creates a surrounding annulus 24 which may be gravel packed to enable removal of particulates from inflowing hydrocarbon fluids during subsequent production operations. The downhole completion 20 comprises at least one and often a plurality of sand screen assemblies 26 combined with an alternate path system 28. Each sand screen assembly 26 may comprise a variety of components which may include a sand screen 30 surrounding a base pipe 32.

In the example illustrated, the alternate path system 28 comprises a plurality of shunt tubes 34 which include transport tubes 36 and packing tubes 38. Additionally, the alternate path system 28 may comprise a manifold 40 associated with each sand screen assembly 26 or with groups of sand screen assemblies 26. The transport tubes 36 and packing tubes 38 are connected to corresponding manifolds 40. As described in greater detail below, each manifold 40 may be used to place a transport tube or tubes 36 into fluid communication with a corresponding packing tube or tubes 38.

Figure 2:
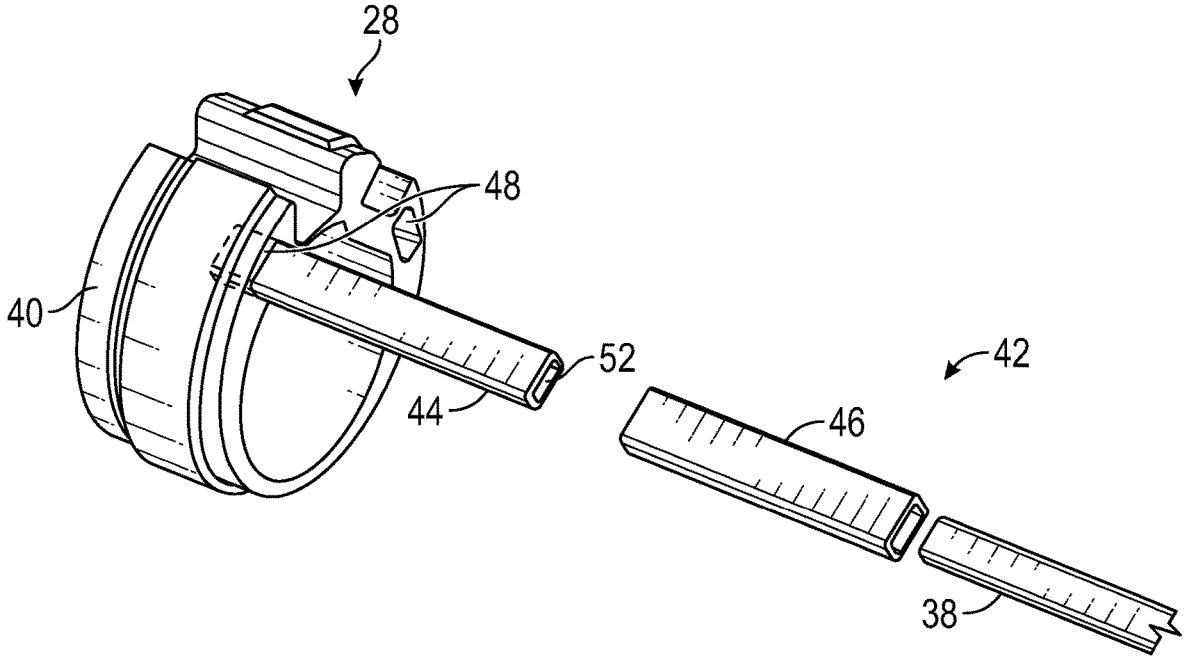
FIG. 2 is an exploded view of a portion of an example of an alternate path system combining a packing tube with a manifold, according to an embodiment of the disclosure.

The alternate path system 28 is constructed to sustain erosive flow of slurry for greater amounts of proppant so as to facilitate gravel packing of extended reach wells. Referring generally to FIG. 2, an example of an erosion protection system 42 is illustrated. In this embodiment, the erosion protection system 42 comprises a packing tube liner 44 which is positioned in fluid communication with the corresponding packing tube 38. The packing tube liner 44 may be formed from a suitably erosion resistant material which is more erosion resistant than the material forming manifold 40 or packing tube 38. By way of example, the packing tube liner 44 may comprise carbide or ceramic although other erosion resistant materials may be used in various applications.

A housing 46 may be positioned around the packing tube liner 44, e.g. along an external surface of the packing tube liner 44. In some embodiments, the packing tube 38 may be joined to the packing tube liner 44 via the housing 46. However, other types of fastening techniques may be used to place the corresponding packing tube 38 in fluid communication with the packing tube liner 44 while maintaining pressure integrity. Effectively, the packing tube(s) 38, housing 46, and manifold 40 are joined in a manner which provides pressure integrity between the manifold 40 and the packing tube(s) 38 while housing the liner 44.

Figure 3:
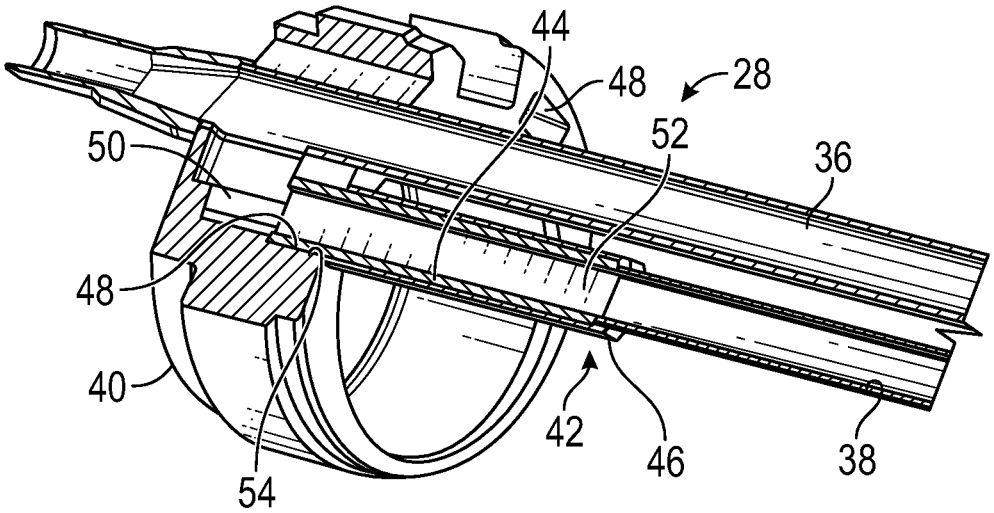
FIG. 3 is a cutaway view of a portion of an example of an alternate path system having a transport tube in fluid communication with a packing tube through a crossover port in a manifold, according to an embodiment of the disclosure.

With additional reference to FIG. 3, the packing tube liner 44 may be inserted into a corresponding recess 48, e.g. a pocket, formed in manifold 40. In the example illustrated, at least one transport tube 36 extends through manifold 40 and is placed in fluid communication with the corresponding packing tube 38 via a crossover port 50. When a gravel slurry is delivered downhole it is able to flow along the transport tube 36 and into the corresponding packing tube 38 via the crossover port 50. According to the embodiment illustrated, the packing tube liner 44 comprises an internal passage 52 through which fluid, e.g. gravel packing slurry, may flow from crossover port 50 and into the interior of the corresponding packing tube 38.

The erosion resistant packing tube liner 44 may be partially inserted into the manifold 40 via recess 48 downstream of the crossover port 50 such that the erosion resistant liner 44 traverses the region which may experience erosive, wall-impinging velocities. In some embodiments, the packing tube liner 44 may be fully inserted into the manifold 40 if the recess 48 can be formed of sufficient length. As illustrated, however, the packing tube liner 44 also may be partially inserted into the manifold 40 such that it extends from the manifold 40 and is enclosed and sealed by housing 46.

Effectively, the erosion resistant packing tube liner 44 provides protection against hotspots, e.g. high velocity impingement spots, downstream of the manifold crossover port 50. For example, the liner 44 provides protection at locations along the packing tube flow path where slurry is readjusting to a new flow path as it transitions from the transport tube 36 to the packing tube 38. The erosion resistant packing tube liner 44 is thus able to extend the life of the alternate path system 28 and to facilitate use of the alternate path system 28 in gravel packing extended reach wells.

In some embodiments, the erosion resistant liner 44 is protected from internal pressures and this capability facilitates use of the alternate path system 28 in high pressure applications, e.g. applications in which the manifolds 40 are constructed with pressure capacities up to 10,000 psi or more. The erosion resistant liner 44 may be isolated from pressure by enclosing it within a sealed, e.g. seal-welded, pressure bearing cavity 54. In the example illustrated, the pressure bearing cavity 54 is formed by recess 48 in combination with housing 46.

For example, the erosion resistant liner 44 may be partially inserted into the recess 48 and then housing 46 may be slid over the erosion resistant liner 44. The housing 46 may then be seal-welded or otherwise sealed to the manifold 40. It should be noted the internal passage 52 of the liner 44 may have a similar shape to and be aligned with the downstream path created by crossover port 50. The corresponding packing tube 38 may then be inserted into the end of the liner housing 46 (see FIG. 3) and welded or otherwise sealably secured to the housing 46. This construction effectively captures the erosion resistant liner 44 within the cavity 54 formed by recess 48 and housing 46.

Thus, when pressure is applied, the pressure is retained by the transport tube(s) 36, manifold 40, housing 46, and packing tube(s) 38 while the pressure is fully balanced inside and outside of the erosion resistant packing tube liner 44. The manifold 40, housing 46, and packing tube(s) 38 may be formed of similar metals to facilitate welding together of these components to achieve a seal between the manifold 40, housing 46, and corresponding packing tube 38 when creating cavity 54 for holding liner 44. In some embodiments, sealing engagement may be formed between dissimilar materials, e.g between dissimilar metals.

Figure 4:
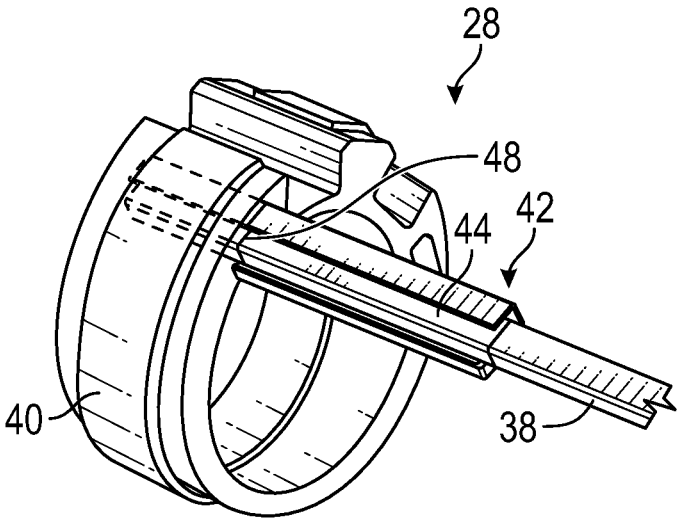
FIG. 4 is an illustration of another example of an alternate path system having a packing tube coupled with a corresponding manifold, according to an embodiment of the disclosure.
Figure 5:
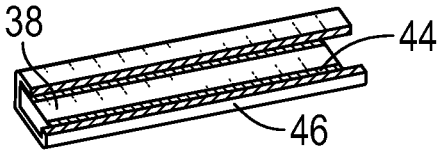
FIG. 5 is a cross-sectional view of the packing tube, liner, and housing of FIG. 4, according to an embodiment of the disclosure.

Referring generally to FIG. 4 and FIG. 5, another embodiment of erosion protection system 42 is illustrated. In this example, the erosion resistant liner 44 is disposed along an end of the packing tube 38. By way of example, the erosion resistant liner 44 may comprise at least one cover, e.g. plates, or cladding, e.g. carbide cladding, disposed along the outside diameter of the end of the packing tube 38. A portion of the end of packing tube 38 may be left exposed for insertion into recess 48.

The housing 46 may then be installed along the exterior of the plating or cladding used to form liner 44. The housing 46 may be seal welded or otherwise sealably attached to the manifold 40 and the corresponding packing tube 38. The sealed housing 46 is able to maintain pressure integrity and pressure capacity even if the wall of the packing tube 38 erodes and exposes the plating or cladding of liner 44. In this embodiment, the liner 44 is once again captured in a cavity so pressure is able to balance inside and outside of the erosion resistant packing tube liner 44.

Depending on the parameters of a given application, the completion 20 may have many types of components arranged in various configurations. For example, the completion 20 may comprise multiple screen assemblies 26 and the alternate path system 28 may be constructed in various arrangements. In some applications, a plurality of transport tubes 36 and packing tubes 38 may be coupled with each manifold 40. Each of the packing tubes 38 may be coupled to the corresponding manifold 40 via erosion protection systems 42 such as those described herein. Similarly, the alternate path system 28 may be constructed for various types of gravel packing operations over wellbores of various extended lengths and through differing numbers of well zones.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion system having:

a screen assembly; and an alternate path system disposed along the screen assembly, the alternate path system comprising a transport tube and a packing tube placed in fluid communication at a manifold disposed along the screen assembly, the packing tube being protected against erosion by a liner comprising a material more resistant to erosion than a material forming the manifold and a material forming the packing tube and a housing surrounding at least the liner, the liner being positioned to conduct fluid flow from the manifold as the fluid flow moves from the transport tube, through the manifold, and into the packing tube, wherein the housing is positioned along an exterior surface of the liner and sealably attached to the manifold and the packing tube to trap the liner in a sealed cavity.

2. The system as recited in claim 1, wherein the liner is inserted into a recess in the manifold and placed in fluid communication with the packing tube.

3. The system as recited in claim 1, wherein the liner comprises carbide.

4. The system as recited in claim 1, wherein the liner comprises ceramic.

5. A method comprising:

deploying a completion system comprising a screen assembly and an alternate path system disposed along the screen assembly in a wellbore, wherein the alternate path system comprises a transport tube and a packing tube placed in fluid communication at a manifold disposed along the screen assembly, the packing tube being protected against erosion by a liner comprising a material more resistant to erosion than a material forming the manifold and a material forming the packing tube and a housing surrounding at least the liner, wherein the housing is positioned along an exterior surface of the liner and sealably attached to the manifold and the packing tube to trap the liner in a sealed cavity;

using a gravel slurry to carry proppant through the transport tube and into the packing tube via a crossover port in the manifold in a gravel packing operation;

conducting fluid flow of the gravel slurry from the manifold as the fluid flow moves from the transport tube, through the manifold, and into the packing tube via the liner; and delivering gravel slurry to an annulus of the wellbore by diverting fluid flow through the crossover port in the manifold from the transport tube into the packing tube, thereby packing the annulus and the packing tube.

6. The method as recited in claim 5, wherein the liner is inserted into a recess in the manifold and placed in fluid communication with the packing tube.

7. The method as recited in claim 5, wherein the liner comprises carbide.

8. The method as recited in claim 5, wherein the liner comprises ceramic.

* * * * *